United States Patent [19]

McLeod

[11] Patent Number: 4,870,765

[45] Date of Patent: Oct. 3, 1989

[54] PICTURE DISPLAY CASE

[76] Inventor: Whitney G. McLeod, Gunther Islands, Eureka, Calif. 95501

[21] Appl. No.: 16,297

[22] Filed: Feb. 19, 1987

[51] Int. Cl.[4] ..... A47G 1/06

[52] U.S. Cl. ..... 40/152

[58] Field of Search ..... 40/152, 16, 156, 10 D, 40/124.2, 642, 611

[56] References Cited

U.S. PATENT DOCUMENTS

| | | | |
|---|---|---|---|
| 2,581,843 | 1/1952 | Edwards | 40/152.1 |
| 2,985,977 | 5/1961 | Roseman | 40/156 |
| 3,676,942 | 7/1972 | Elrod | 40/124.2 |
| 4,041,630 | 8/1977 | Holbrook | 40/16 |
| 4,261,122 | 4/1981 | LeVine | 40/152 |
| 4,356,647 | 11/1982 | Farris | 40/10 D |
| 4,423,563 | 1/1984 | Ondricek | 40/152 |
| 4,594,802 | 1/1986 | Field | 40/10 D |

*Primary Examiner*—Gene Mancene
*Assistant Examiner*—Cary E. Stone
*Attorney, Agent, or Firm*—Philip A. Dalton

[57] ABSTRACT

A display case for pictures, photographs and the like comprising a frame having sides which form top lips which extend the length of the sides and have grooves on the inside faces thereof to permit sliding insertion and removal of a viewing cover sheet and picture mat.

2 Claims, 1 Drawing Sheet

FIG. 1
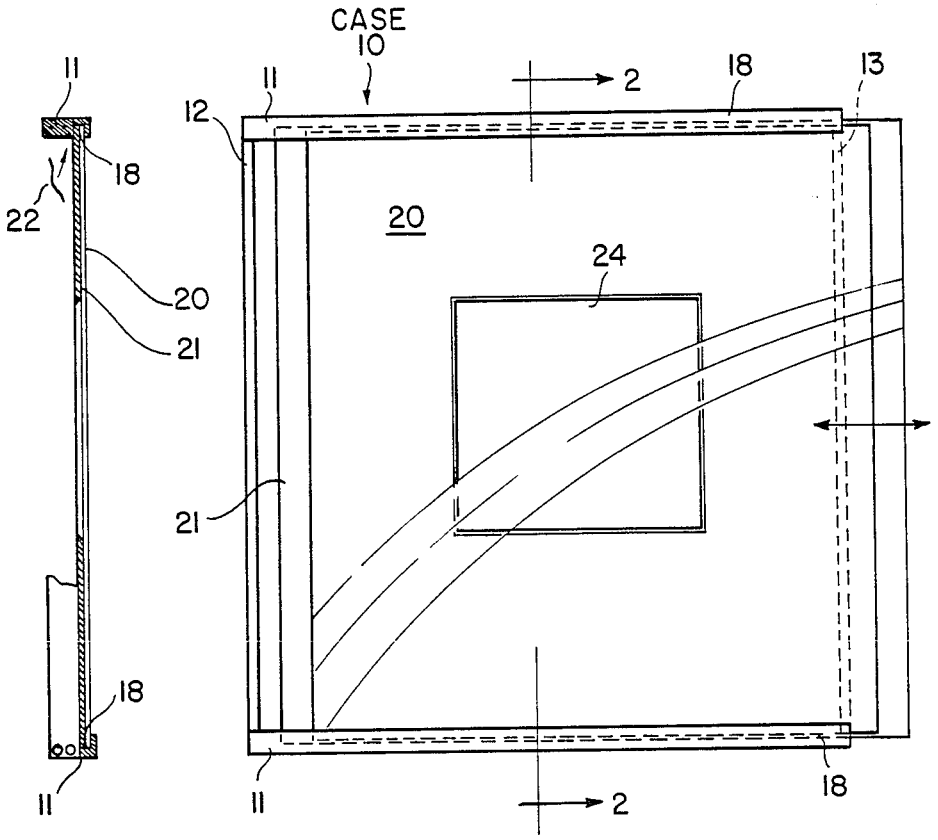
FIG. 2
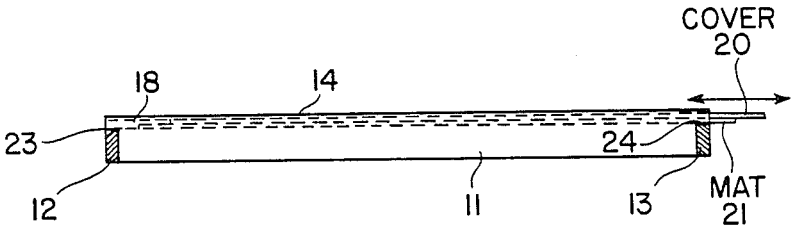
FIG. 3

PICTURE DISPLAY CASE

BACKGROUND OF THE INVENTION

The present invention relates generally to display cases or frames for flat objects such as pictures or paintings and, in particular, to a display case which has a viewing cover that is readily removable/replaceable.

Conventional picture frames and picture display cases typically comprise either an open frame which exposes the painting or picture or other displayed article (hereafter also collectively termed "picture") to the ambient, or a closed case having a transparent glass or plastic cover which is semi-permanently mounted to or within the frame. In one prevalent system, the cover is positioned against lips or shoulders inside the frame, the picture and any supporting mat are mounted flush against the back of the cover, and the mat-picture-cover assembly is secured by clips or points or the like which are attached to the frame.

Alternatively, the view-through cover may be positioned within peripheral grooves on the inside of the four frame members, which are fastened together by means such as nails or glue.

In different art, i.e., that involving wood storage boxes, slide top boxes have been used in which the top or closure is inserted and removed along grooves in the sides of the box.

SUMMARY OF THE INVENTION

In view of the above-described state of the art, it is a primary object of the present invention to provide a view-through picture display case or frame having a cover which is easily removed and replaced, yet securely retained to the case.

It is another object to provide such a view-through picture display case in which access to the cover, the picture and, preferably, any associated mat or support is from the front of the case and the cover, picture and mat can be removed and repositioned together.

A picture display case which achieves the above and other objectives and embodies my present invention comprises a flat see-through cover sheet; a frame comprising a pair of opposite side members, having inner faces having substantially parallel grooves therein, one on each inner face, for slidably receiving the cover; and fastening means for securing the sheet within said grooves.

BRIEF DESCRIPTION OF THE DRAWINGS

The above and other aspects of the invention are disclosed in the drawings, wherein:

FIG. 1 is a front elevational view of a picture display case which embodies my present invention;

FIG. 2 is a sectional view taken along line 2—2 in FIG. 1; and

FIG. 3 is a side elevational view of the case of FIG. 1.

DETAILED DESCRIPTION OF THE INVENTION

FIG. 1 is a front elevational view of a presently preferred embodiment of my picture display case 10. The case 10 comprises a pair of opposite side frame members 11—11 and a pair of connecting end members 12 and 13. The frame may comprise a floor or base (not shown) which is positioned within grooves near the rear or bottom side of the case 10 or, alternatively, intermediate the bottom and the grooves 18—18.

Referring to FIGS. 1–3, two longitudinally extending parallel grooves 18—18 are formed in the facing inner sides of side members 11—11. A preferably transparent or translucent rectangular viewing cover 20 is of a size to allow sliding along the grooves 18—18 to accomplish ready installation and removal of the cover. In addition, a flat, sheet support 21, such as a mat, for mounting items 24 such as pictures, photographs, messages and the like, is positioned beneath the cover 20 and can be inserted and removed along with the cover.

The picture support 21 and see-through cover 20 can be retained in position, e.g., by resilient flat spring clips 22, FIG. 2, which are inserted into grooves 18—18 beneath/behind the mat and cover after the mat and cover are in place.

Referring primarily to FIG. 3, the end members 12 and 13 are of relatively short height so that the tops 23 and 24 thereof are below grooves 18—18, and the grooves 18—18 extend the length of side members 11—11. This permits insertion and removal of the mat 21 and cover 20 from either end.

Based upon the above disclosure of preferred and alternative embodiments, those of usual skill in the art will readily derive additional embodiments of my invention which are within the scope of the claims.

I claim:

1. A display case comprising: a flat viewing cover sheet having opposite sides; a frame comprising a pair of opposite end members and a pair of opposite side members, the side frame members having inner faces having substantially parallel grooves therein, for slidably receiving the cover sheet; said grooves extending the length of the side frame members over the end frame members for permitting insertion and removal of the cover sheet from either end; and securing means of size for insertion within said grooves for securing the cover sheet against sliding along said grooves.

2. The display case of claim 1, further comprising a support sheet sized for sliding insertion and removal along said grooves.

* * * * *